United States Patent [19]

Gullers

[11] Patent Number: 4,589,865

[45] Date of Patent: May 20, 1986

[54] CENTRIFUGAL SEPARATOR WITH CENTRAL SLUDGE DISCHARGE

[75] Inventor: Per Gullers, Södertälje, Sweden

[73] Assignee: Alfa-Laval AB, Tumba, Sweden

[21] Appl. No.: 587,516

[22] Filed: Mar. 8, 1984

[30] Foreign Application Priority Data

Mar. 16, 1983 [SE] Sweden ..... 8301427

[51] Int. Cl.[4] ..... B04B 11/00; B04B 11/08

[52] U.S. Cl. ..... 494/26; 494/30; 494/40; 494/57

[58] Field of Search ..... 494/1, 2, 3, 23, 25, 494/26, 27, 28, 29, 30, 38, 40, 56, 57, 58, 59

[56] References Cited

U.S. PATENT DOCUMENTS 3,765,599 10/1973 Hemfort ..... 494/29
3,878,981 4/1975 Teckertrup ..... 494/27
4,410,319 10/1983 Zettier ..... 494/56

FOREIGN PATENT DOCUMENTS 227106 7/1969 Sweden ..... 494/58
2030895A 4/1980 United Kingdom ..... 494/56

*Primary Examiner*—Robert W. Jenkins
*Attorney, Agent, or Firm*—Cyrus S. Hapgood

[57] ABSTRACT

In a centrifuge rotor provided with sludge channels (25) for conveying sludge radially inwards to a sludge receiving chamber (15), from which the sludge is discharged by means of a central sludge discharge means, the openings of the sludge channels (25) into the sludge receiving chamber (15) are controlled by a slide member (14) being actuated to move in one axial direction by spring means (28). To cause the slide member (14) to move in the other axial direction, a pressure chamber (18), sealed against the sludge receiving chamber (15), is arranged between the slide member (14) and the rotor, and a fluid channel (33) extends through the rotor to the pressure chamber (18), connecting the pressure chamber with a pressure source (35) located outside the rotor. A position regulator (32) is situated in a cavity of the rotor, and is arranged to operate directly on said slide member (14) for regulation of its position.

7 Claims, 4 Drawing Figures

CENTRIFUGAL SEPARATOR WITH CENTRAL SLUDGE DISCHARGE

Figure 1:
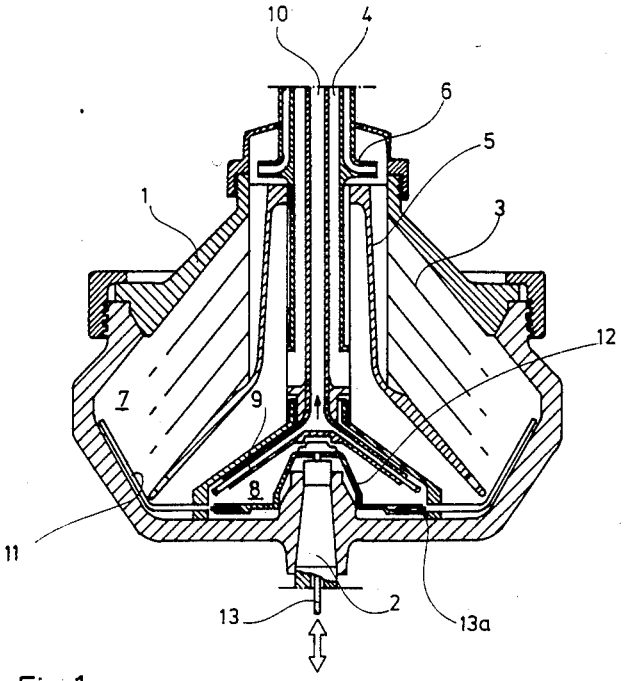

The present invention relates to a centrifugal separator, the rotor of which has channels extending from a sludge space situated at the periphery of the rotor radially inwards to a sludge receiving chamber provided with sludge discharge means. The sludge receiving chamber further is provided with an axially movable slide member for controlling of the openings of said channels in the sludge receiving chamber, said slide member being actuatable in one axial direction by spring means arranged between the slide member and the rotor.

A separator of this kind is described in the Swedish patent specification No. 227 106. At this separator sludge is discharged from the sludge receiving chamber by paring means having paring openings arranged at a relatively large radial distance from the rotor axis, whereby a large driving pressure for the supply of sludge into the sludge receiving chamber is obtained. The sludge supply to the receiving chamber is controlled by uncovering and closing of the openings of the sludge channels in the receiving chamber by means of said slide member. The latter at its periphery is provided with a number of closing elements, one for each channel opening, which are movable radially outwards by the centrifugal force. The uncovering and closing of the channel openings are obtained by axial movement of the slide member which is actuated towards one of its axial end positions by spring force and towards its other axial end position by means of a magnetically created force through a spindle extending through the rotor shaft.

The above described arrangement for controlling the supply of sludge into the sludge receiving chamber, i.e. by alternating uncovering and closing of the channel openings, has not been used in practice. Instead, in practice, the slide member has been operated by means of a complicated equipment situated below the separator. In such an equipment a rotational movement of an adjusting lever is transformed to an axial movement of the slide member spindle. Said adjusting lever is actuated by a piston-cylinder unit, in which the position of the piston is adjustable by means of a position regulator.

The arrangement designed in this manner for controlling of the sludge supply into the sludge receiving chamber is operable in practice but gives an unsatisfying regulation result. It has substantial disadvantages concerning rapidity as well as accuracy of the regulating movements of the slide member.

The object of the present invention is to eliminate said disadvantages and to provide a rapid and exact adjustment of the slide member controlling the supply of sludge into the sludge receiving chamber. This object can be achieved at a centrifugal separator of the initially described kind in that a pressure chamber, sealed from the sludge receiving chamber, is formed between the slide member and the rotor, in that the pressure chamber is connectable, through a fluid channel in the rotor, to a pressure fluid source stituated outside the rotor for actuating the slide member in the other axial direction, i.e. opposite to the direction in which the slide member is actuated by spring force, and that a position regulator is situated in a cavity of the rotor and arranged to act directly on the slide member for regulation of its position.

This invention has provided a very compact and inexpensive regulation equipment comprising a relatively small number of components. This has been possible by the use of means and spaces of the centrifugal separator itself for functions which have previously been performed by separate equipment.

Above all, however, the invention has provided a regulation equipment which fulfills very high requirements on regulation accuracy set by processes in which centrifugal separators of the kind here in question are to be used. This has been possible primarily for two reasons. First, by the invention a position regulator has been arranged in a manner such that it actuates the above mentioned slide member directly instead of through a piston-cylinder unit and force transmitting couplings of various kinds. Secondly, by the invention it has been possible to make the effective pressure area for the pressue fluid used and, thereby, the force utilized for the regulation, relatively large, since the slide member itself within the rotor has been used instead of a separate piston-cylinder unit. A piston-cylinder unit having a corresponding pressure area would be very large and expensive.

Figure 2:
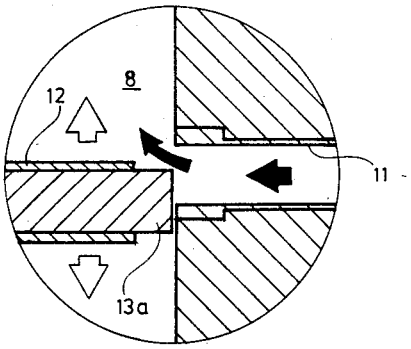
Figure 3:
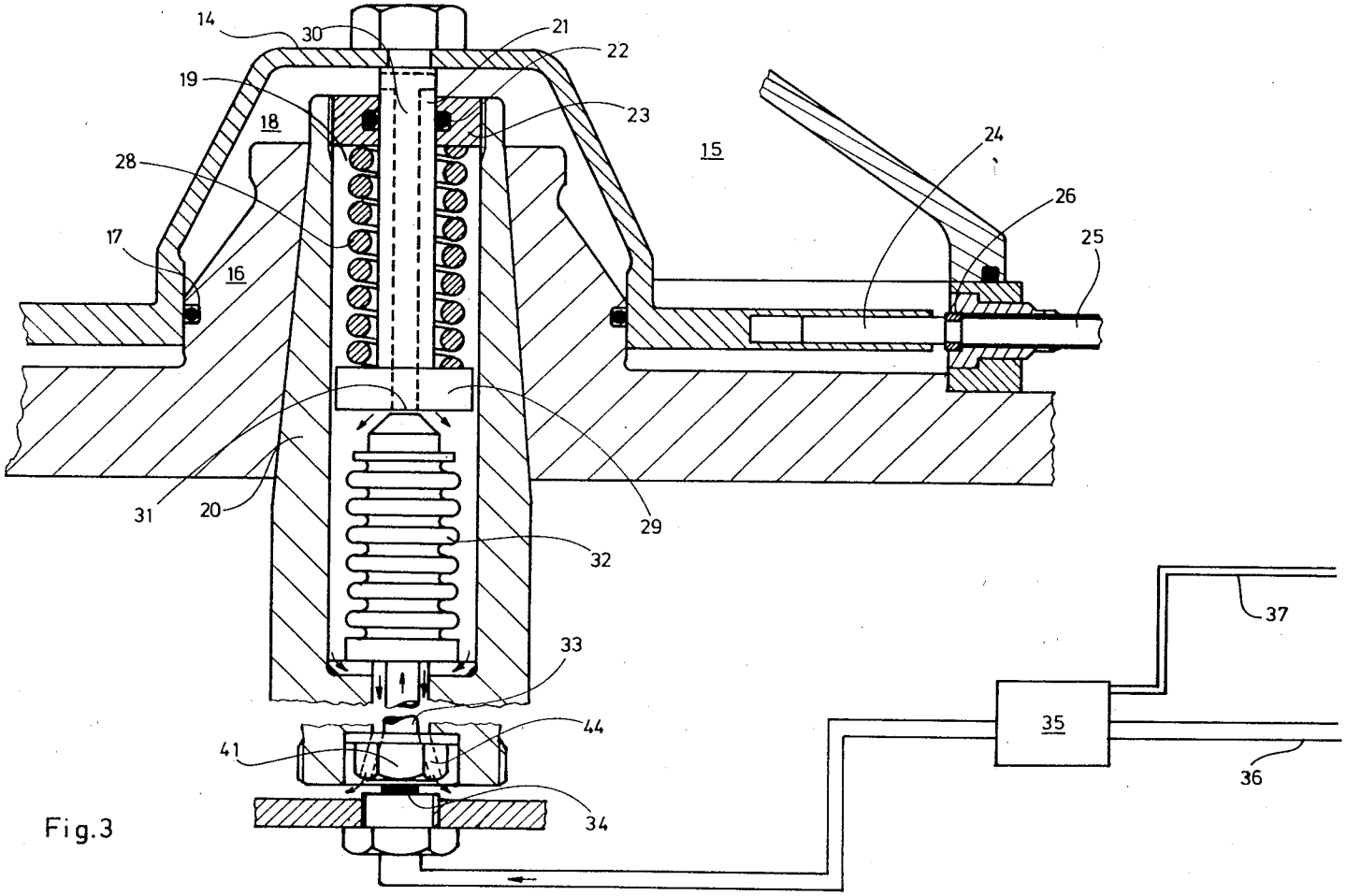
Figure 4:
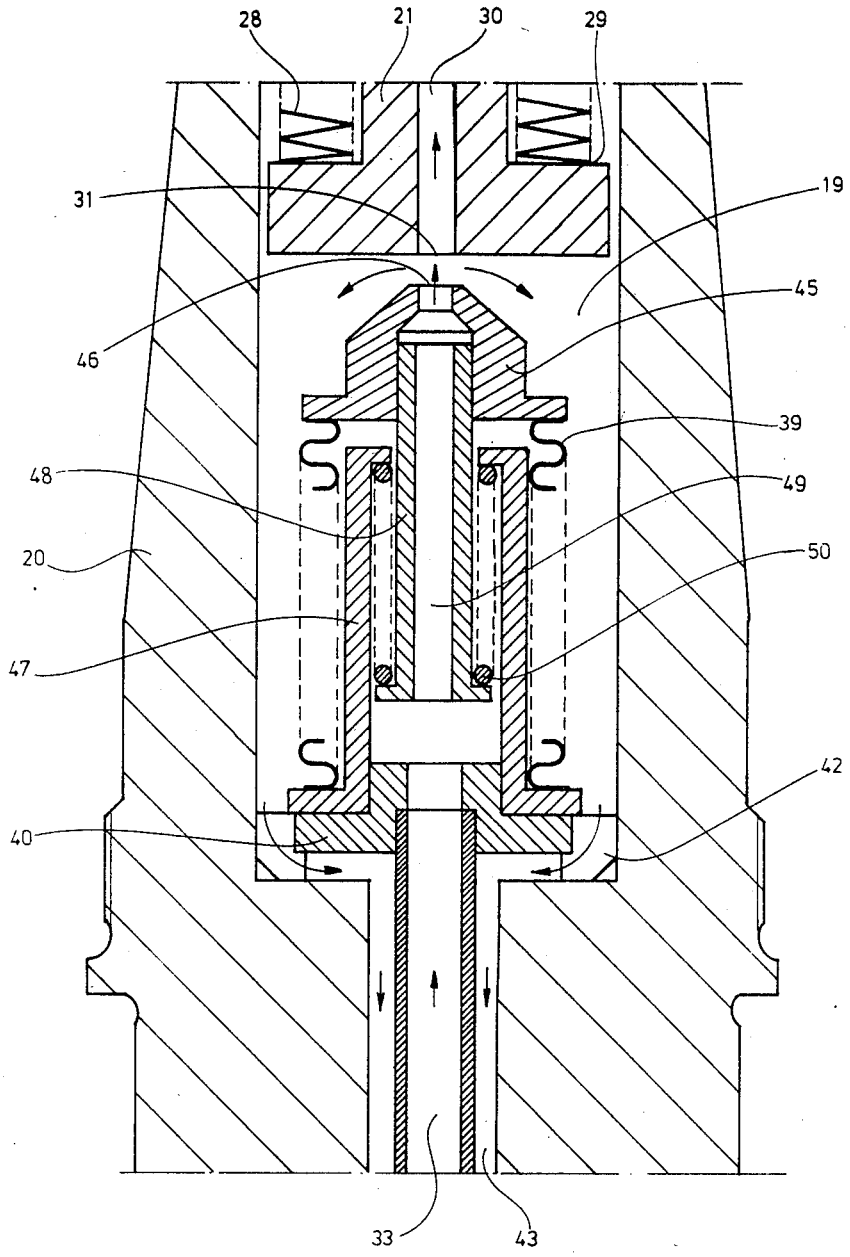

The invention will be described more in detail with reference to the accompanying drawing, in which FIG. 1 shows a section through a separator with conventional mechanical slide operation, FIG. 2 is a view of part of the separator in FIG. 1, FIG. 3 shows in section part of a separator with slide operation according to the invention, and FIG. 4 shows in section a position regulator mounted within the rotor shaft.

FIG. 1 shows schematically the type of centrifugal separator concerned by the invention with mechanical adjustment of the axial position of a slide member for controlling the supply of sludge into a central sludge receiving chamber. The centrifuge rotor 1 is driven by a hollow shaft 2, and is provided with a set of plates 3, an inlet 4, a distributor 5, paring means 6 for discharge of clarified liquid, and a peripheral sludge space 7. At the rotor bottom there is arranged a central sludge receiving chamber 8 with paring pipes 9 for paring off sludge through a central outlet 10. From the sludge space 7 a number of bent tubes 11 extend to the sludge receiving chamber 8. In this chamber there is also arranged a slide plate 12, the axial position of which is controlled by means of a connecting rod 13 extending through the hollow rotor shaft 2. At the periphery of the slide member 12 there are arranged a number of piston members 13*a*, one for each sludge tube 11, radially movable by the centrifugal force for opening and closing of the tube openings in the sludge receiving chamber 8. The regulation of the openings of the sludge tubes 11 in the sludge receiving chamber 8 by means of the axial adjustment of the slide member 12 is shown in FIG. 2.

FIG. 3 shows part of the separator with the pneumatical control system according to the invention. A slide plate 14 in a sludge receiving chamber 15 is axially guided by the rotor hub 16 and is sealed against the same by an O-ring gasket 17, so that a pressure chamber 18 is formed between the slide plate and the rotor hub. The slide plate 14 further is centrally guided by a portion 21 extending into a cavity 19 in the rotor shaft 20, and is sealed through an O-ring gasket 22 against a bushing 23 closing the cavity 19 from the pressure chamber 18. The slide plate has radially movable piston members 24 for controlling of the openings 26 of the sludge tubes 25 into the sludge receiving chamber 15. The slide plate, further, is actuated toward its axial bottom position by a spring 28 arranged between the bushing 23 and a spring shoulder 29 on the slide portion 21. Said portion 21 further is penetrated by an air channel 30 which opens upwards into the pressure chamber 18 and downwards through a nozzle opening 31 into the cavity 19.

Within the cavity 19 of the rotor shaft there is also arranged a pneumatic position regulator 32, the operation of which is described in connection with FIG. 4. Pressurized air is supplied to the position regulator through an air channel 33 extending centrally within the rotor shaft, and communicating at the lower end of the rotor shaft through a stationary graphite bushing 34 with a pneumatic control unit 35 provided with a connection 36 to a pressurized air source, and control signal lines 37.

FIG. 4 shows in detail one embodiment of the pneumatic position regulator arranged within the rotor shaft. It comprises bellows 39, the lower end of which is fastened to an end piece 40 which in turn is fastened to the bottom of the cavity 19 by means of the central air supply pipe 33, said pipe 33 through the end piece 40, communicating with the space within the bellows 39 and being fastened at its other end, shown in FIG. 3, to the lower part of the rotor shaft by means of a nut 41. The end piece 40 rests against support members 42, through which channels for leaking air extend for the communication between the cavity 19 and an outlet channel 43 formed around the central pressurized air pipe 33. The channel 43 opens into the ambient air at the rotor shaft end through channels 44 in the nut 41 shown in FIG. 3. The upper free end of the bellows 39 is connected to an axially movable nozzle 45 with a nozzle opening 46 which is turned in a direction towards the nozzle opening 31 in the slide plate 14. For further axial guidance a sleeve member 47 is fastened to the end piece 40 for guiding of a guide spindle 48 connected to the nozzle 45 and having a central through-hole 49 for pressurized air. Between the guide sleeve 47 and the guide spindle 48 a spring 50 is arranged to force the nozzle 45 towards its lower end position.

By means of the position regulator thus shown a rapid and safe adjustment of the axial position of the slide member is obtainable. Control signals, for instance in the pressure inteval 0,2–1,0 bar, are supplied to the pneumatic control unit, whereat the control unit delivers an air pressure of sufficient magnitude to actuate the slide member upwards, for instance a pressure in the order of 3–5 bar. At a sudden increase, for instance, of the operating pressure the spring loaded nozzle of the position regulator will immediately move upwards, since the friction in the regulator, having no movable sealings, is negligible. Then the nozzle openings in the position regulator and the slide member are brought into contact with each other, a substantial increase of the pressure below the slide member suddenly being obtained owing to the reduced leakage slot between the nozzle openings. The nozzle of the position regulator will take a position in proportion to the supplied pressure, and a leakage slot between the nozzle openings will again be formed, the slide member being axially displaced upwards in correspondence to the movement of the position regulator nozzle. When the operating pressure is lowered, there is occuring a corresponding rapid and instantaneous enlargement of the leakage slot between the nozzle openings, and a rapid displacement downwards of the slide member. Thus, any axial position of the slide member 14, controlling the degree of uncoverage of the tube openings 26, and dictated for instance by some indication of the concentration of the sludge discharged through the outlet pipe 10, is achievable in a rapid and accurate manner.

I claim:

1. A centrifugal separator comprising a rotor mounted for rotation about an axis, the rotor having an outer wall surrounding a sludge space situated at the periphery of the rotor and also having a sludge receiving chamber, means forming sludge channels extending from said sludge space radially inwards to said sludge receiving chamber, said channels having openings leading into said chamber, means for discharging sludge from said chamber, an axially movable slide member for controlling said channel openings, spring means arranged between said slide member and the rotor and operable to actuate the slide member in one axial direction, the rotor having a pressure chamber located between said slide member and the rotor and sealed from said sludge receiving chamber, the radially outer part of said pressure chamber being spaced a substantial distance radially inward from said outer wall of the rotor, the rotor also having a fluid channel and a cavity, a pressurized fluid source situated outside the rotor and connectable through said fluid channel to said pressure chamber to actuate the slide member through a displacement range in the other axial direction, and a position regulator located in said cavity and operable directly on the slide member under control of fluid from said fluid channel to hold the slide member in different positions within said displacement range.

2. Centrifugal separator according to claim 1, in which said position regulator has a passage through which said fluid channel communicates with said pressure chamber.

3. Centrifugal separator according to claim 1, in which said pressure fluid source is a pressurized air source.

4. A centrifugal separator comprising a rotor mounted for rotation about an axis, the rotor having an outer wall surrounding a sludge space situated at the periphery of the rotor and also having a sludge receiving chamber, means forming sludge channels extending from said sludge space radially inwards to said sludge receiving chamber, said channels having openings leading into said chamber, means for discharging sludge fron said chamber, an axially movable slide member for controlling said channel openings, spring means arranged between said slide member and the rotor and operable to actuate the slide member in one axial direction, the rotor having a pressure chamber located between said slide member and the rotor and sealed from said sludge receiving chamber, the radially outer part of said pressure chamber being spaced a substantial distance radially inward from said outer wall of the rotor, the rotor also having a fluid channel and a cavity, a pressurized fluid source situated outside the rotor and connectable through said fluid channel to said pressure chamber to actuate the slide member through a displacement range in the other axial direction, and a position regulator located in said cavity and operable directly on the slide member under control of fluid from said fluid channel to hold the slide member in different positions within said displacement range, said slide member comprising a portion extending into said cavity and provided with a further channel one end of which opens into said pressure chamber and the other end of which has a first nozzle with a first opening facing said cavity, said position regulator comprising means forming a working chamber adapted for expansion axially of the rotor by pressurized fluid from said source, said regulator comprising also a spring opposing said axial expansion of said working chamber, the position regulator having a second nozzle with a second opening facing said first nozzle opening and movable relative to said first opening by said axial expansion, said fluid channel communicating with said working chamber to supply fluid thereto from said source, the rotor having an outlet channel leading from said cavity for discharging fluid which leaks from a self-adjusting slot between said nozzle openings.

5. Centrifugal separator according to claim 4, in which said means forming a working chamber is a bellows one end of which is stationary in said cavity and connected to said fluid channel for supply of pressurized fluid, the other end of the bellows being connected to said second nozzle.

6. Centrifugal separator according to claim 5, in which said position regulator comprises also first and second guiding elements disposed in concentric relation to each other and located within said bellows, said first guiding element being stationary in said cavity, said second guiding element being connected to said second nozzle and movable relative to said first element while guided by said first element.

7. Centrifugal separator according to claim 6, in which said position regulator comprises also spring means supported by said guiding elements and urging said second nozzle in a direction away from said first nozzle.

* * * * *